United States Patent [19]

Martin

[11] Patent Number: 4,473,156

[45] Date of Patent: Sep. 25, 1984

[54] METHOD AND APPARATUS FOR ACCURATELY SELECTING STORING AND DISPENSING PILLS

[75] Inventor: David C. Martin, Pittsburgh, Pa.

[73] Assignee: St. Paul-Ramsey Hospital Medical, St. Paul, Minn.

[21] Appl. No.: 439,393

[22] Filed: Nov. 5, 1982

[51] Int. Cl.[3] ..... G09F 3/08; G09F 9/00; B65B 1/24; B65D 85/56

[52] U.S. Cl. ..... 206/534; 116/308; 206/459; 220/345

[58] Field of Search ..... 206/534, 459; 220/345; 116/308

[56] References Cited

U.S. PATENT DOCUMENTS

| | | | |
|---|---|---|---|
| 3,225,913 | 12/1965 | Lee | 206/534 |
| 3,393,794 | 7/1968 | Borin | 220/345 |
| 3,530,818 | 9/1970 | Secondino | 116/308 |
| 3,537,422 | 11/1970 | Moe | 116/308 |
| 3,618,559 | 11/1971 | Moe | 116/308 |
| 3,738,480 | 6/1973 | Chesley | 206/534 |
| 3,826,222 | 7/1974 | Romick | 116/308 |
| 3,921,806 | 11/1975 | Wawracz | 206/534 |
| 3,996,879 | 12/1976 | Walton | 116/308 |
| 4,038,937 | 8/1977 | Moe | 116/308 |
| 4,039,080 | 8/1977 | Cappuccilli | 206/534 |
| 4,148,273 | 4/1979 | Hollingsworth et al. | 116/325 |

OTHER PUBLICATIONS

Article entitled "Reducing Medication in a Geriatric Population", *Journal of the American Geriatric Society*, vol. 30, No. 4, pp. 258–260.

*Primary Examiner*—William T. Dixson, Jr.

*Attorney, Agent, or Firm*—Schroeder, Siegfried, Vidas & Arrett

[57] ABSTRACT

An apparatus for accurately selecting, storing and dispensing multiple varieties of pills at preselected time intervals such as morning, noon, evening and night includes a separate pill container for each unique variety of pill to be dispensed. Each pill container is identified by a distinctive color or colors to indicate the time interval(s) during which the pill in it are to be dispensed. For example, each container for pills to be dispensed in the morning will be identified at least by the color red; at noon, at least yellow; in the evening, at least blue; and at night at least black. Any particular container will, therefore, be identified by at least one and not more than four colors. A pill tray includes a plurality of pill holding compartments arranged in columns identified with each of the days of the week and in row, each row representing one of the time intervals, such as morning, noon, evening and night. Each pill holding compartment in the row representing morning is colored red, the row representing noon is colored yellow, the evening row is colored blue, and the night row is colored black. The tray is loaded by putting one pill from each container in each of the compartments colored the same as one of the colors identifying that container. Sliding panels are provided as covers for each of the columns, and the patient can access the proper medication by uncovering the appropriate compartment at the appropriate time interval. For example, on Monday morning, the patient slides the "Monday" panel down far enough to uncover the Monday morning compartment, removes the pills and ingests them.

12 Claims, 4 Drawing Figures

MON.
TUES.
WED.
THURS.
FRI.
SAT.
SUN.
MORNING
NOON
EVENING
NIGHT

METHOD AND APPARATUS FOR ACCURATELY SELECTING STORING AND DISPENSING PILLS

BACKGROUND OF THE INVENTION

1. Field of the Invention

This invention has relation to an apparatus and method for increasing compliance with prescribed regimes of medication by mature patients.

A general text of geriatric medicine (Libow LS, Sherman FT: *The Core of Geriatric Medicine: A Guide for Student and Practitioners,* published in St. Louis in 1981 by CV Mosby Co., at Page 107) notes that between 30% and 50% of all patients fail to comply with their physicians' prescriptions. Interviews conducted with 178 elderly outpatients revealed that 59% are making errors in their medications and about ¼ of the group as a whole averaged as many as 2.3 potentially serious errors per patient (Schwartz D, Wang M, Zeitz L. et al: *Medication Errors Made by Elderly, Chronically Ill Patients,* published in the American Journal of Public Health 52:2018–29, 1962).

A study examining non-compliance in patients recently discharged from an acute care facility found that 50% of the patients deviated from the prescribed regime (Parkin DM, Henney CR, Quirk J, et al: *Deviation from Prescribed Drug Treatment After Discharge from Hospital,* published in the British Medical Journal 2:686, 1976).

Medication errors are an important factor in producing illness. Up to 5% of patients may have a drug-induced illness upon admission to the hospital, according to Seidl, LG, Thomtom GF, Smith JW, et al: *Studies On the Epidemiology of Adverse Drug Reactions,* published in The Bulletin of Hopkins Hospital at 119:299–315, 1966. A high percentage of the patients having such drug-induced illness may not be due to the inherent toxitity of the drug, but rather to its improper use. (Stewart RB, Cluff, LE: *A Review of Medication Errors in Compliance with Ambulant Patients,* published in Clinical Pharmacy and Therapy, 13(4):463–468, 1972).

As a group, the elderly are the greatest consumers of prescription and non-prescription medicines. Persons over age 65 constitute 11% of the population, but account for more than 25% of drug expenditures (Gibson RM, Mueller MS, Fisher CR: *Age Differences in Health Care Spending, Fiscal Year* 1976, published in Social Security Bulletin 40-3-4, 1977).

The factors which play a role in this poor patient compliance include poor patient motivation, failure to develop a trusting relationship with the physician, memory loss and other cognitive dysfunctions, attenuation of the special senses, and a lack of sufficient knowledge on the part of the patient. Factors such as congnitive dysfunction, poor eyesight, and lack of patient education may be overcome with memory devices and improved instruction. Because the geriatric patient is prone to these problems, the geriatric population is a logical target group to test compliance-improving strategies.

2. Description of the Prior Art

The apparatus and method of the present invention were developed in order to overcome the problem of non-compliance with physicians' prescriptions, and the invention was then tested against other strategies and were simultaneously compared to a control group. These strategies included standardized instructions with tapes and transcripts; color-coded pill bottles; and color-coded pill bottles matched to a color-coded weekly pill tray in accordance with the invention. The group using the apparatus and method of the present invention did significantly better than the control group while the group employing the other two strategies did not.

Specifically, the control group deviated an average of 17.1% from the ideal pill counts made at the end of the tests; the group receiving standardized instruction deviated 14.1%; the group using color-coded pill bottles alone deviated by 17.3%; and the group using the apparatus and method of the present invention deviated by an average of only 1.7%.

It is known to provide filled dispensers which include 28 separate pill-receiving compartments, and it is known to provide covers for such dispensers whereby the compartments can be accessed one at a time; but the accuracy in adhering to the prescribed regime by accessing the proper compartment at the proper time can be no greater than the accuracy in loading the pills into the individual compartments. See the following U.S. patents: U.S. Pat. No. 3,921,806, granted to Wawracz in November of 1975; U.S. Pat. No. 3,225,913, granted to Lee in December of 1965; U.S. Pat. No. 3,530,818, granted to Secondino in September of 1970; U.S. Pat. No. 3,537,422, granted to Moe in November of 1970; U.S. Pat. No. 4,039,080, granted to Cappuccilli in August of 1977; U.S. Pat. No. 3,738,480, granted to Chesley in June of 1973; U.S. Pat. No. 3,618,559, granted to Joe in November of 1971.

The foregoing patents were located in a search made of the present invention. Also located in the search was U.S. Pat. No. 3,996,879 granted to Walton in December of 1976. It discloses a reminder device having a band which fits around a pill container and is not believed to be pertinent to the invention.

A system for handling and dispensing pre-packaged unit doses of medicine for a large number of patients is disclosed in U.S. Pat. No. 3,826,222, granted to Romick in July of 1974. The system is designed for use in hospitals; and is not believed to be applicable for adaptation for use by patients themselves in prepackaging, storing and dispensing complicated regimes of medication at several times a day over a period of a week.

A peg board adapted for use by persons required to take one or more doses of a plurality of medicine over a span of hours and days is presented in U.S. Pat. No. 4,148,273 granted to Hollingsworth et al in April of 1979. The device of this invention would be of little or no value to a geriatric patient attempting to handle his own medication. Certainly the concept of the present invention is not shown or suggested in the Hollingsworth patent.

Applicant and those in privity with him are aware of no prior art closer than that cited and discussed above; and are aware of no prior art which anticipates the claims herein.

SUMMARY OF THE INVENTION

An apparatus for accurately selecting, storing and dispensing multiple varieties of pills at a given number of preselected time intervals during each of a number of time units such as days over a set time period such as a week includes individual pill containers for each unique variety of pill to be dispensed. Each dispenser is marked with indicia keyed to the time interval or time intervals of each time unit of a time period at which a pill dosage in that container is to be dispensed. In the form of the invention shown herein, each individual pill container containing a variety of pill to be dispensed in the morning or at breakfast time will be identified at least by the color red, each pill container containing a variety of pill to be dispensed at noon or lunch time will be identified at least by the color yellow, each pill container containing a variety of pill to be dispensed in the evening or at supper time will be identified at least by the color blue, and each container containing a variety of pill to be dispensed at night or bedtime will be identified at least by indicia which is black.

For use with these pill containers, a pill tray is provided. It includes a plurality of pill holding compartments, each compartment representing one of the time intervals during which pills may be dispensed, the pill holding compartments being arranged in columns each identified with one of the time units of the time period for which the apparatus is designed to dispense pills. The pill holding compartments are also arranged in rows each identified with one of the time intervals common to all of the time units. In the form of the invention shown, the apparatus is designed to dispense pills for the time period of one week, and the time units of that week are the days of the week.

Each pill holding compartment is identified by an indicia similar to the common indicia identifying each of the pill containers holding pills which are to be dispensed during the time interval with which it is associated. In the form of the invention as shown, all of the containers in the back row designed to hold pills to be taken in the morning are identified by the color red, all those in the "noon" row are identified by the color yellow, the "evening" row by the color blue and the night row by "black".

Where the doctor has prescribed no more than one pill of each variety to be dispensed at any one time interval, the pill tray can be loaded or charged very simply and without error by putting one pill from each pill container identified with only one indicia into each pill holding compartment identified with the same indicia. As shown herein, one pill from the pill container colored blue will be placed in each of the tray pilling holding compartments colored blue. A pill from each of the other pill containers identified with more than color but including the color blue will also be placed in each of the blue colored pill holding compartments. Similarly, a pill from each container identified with yellow will be placed into each yellow pill holding compartment, pills from the blue marked containers into the blue compartments, and from the black marked containers into the black compartments.

To insure that the pills will not be mixed up with each other, dropped, or contaminated during the 28 time intervals that the tray will be used during a week, means is provided to cover each pill holding compartment until such time as it needs to be accessed so that pills can be removed from it.

BRIEF DESCRIPTION OF THE DRAWINGS

FIG. 1 is a top plan view of a pill tray made according to the present invention;

DETAILED DESCRIPTION OF THE PREFERRED EMBODIMENTS

Figures 2, 3:
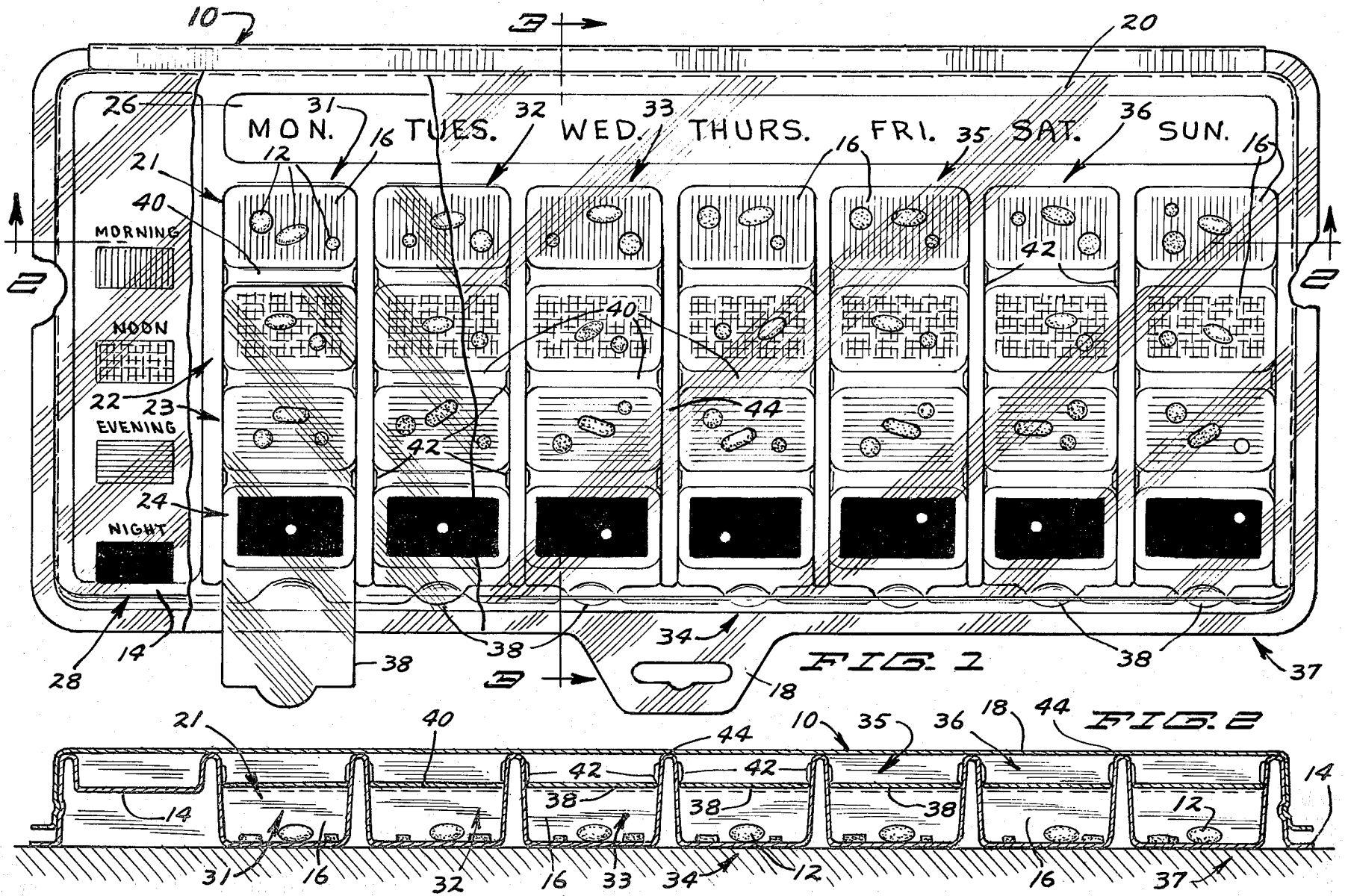
FIG. 2 is a vertical sectional view taken on the line 2—2 in FIG. 1.
FIG. 3 is an enlarged cross sectional view taken on the line 3—3 in FIG. 1.

A tray 10 for receiving, storing and dispensing multiple varieties of pills, tablets and capsules 12 is, in the form of the invention shown, constituted as a base 14 and a plurality of spaced-apart pill holding compartments 16. Such a tray can be formulated in any one of a very large number of ways; but in the form of the invention as shown, is made by a vacuum forming a thermoplastic sheet.

Throughout this specification, the term "pills", will be used to represent the pills, tablets, capsules or other articles to be stored in compartments 16.

As seen in FIG. 1, the compartments 16 are arranged in four rows 21 through 24 and in 7 columns, 31 through 37. Each of these columns represents a unit of time, a day of the week in the form of the invention as shown. Each of the rows represents a time interval within the time unit. In the form of the invention shown, row 21 represents morning or breakfast time, row 22 represents noon or lunch time, row 23 represents evening or supper time, and row 24 represents night or bed time.

A tray cover 18 is hingedly mounted as at 20 to the tray base 14. For clarity of illustration, a portion of the cover 18 is broken away to allow illustration of at least the column 31 of compartments 16 as when the tray is actually being used for dispensing pills.

As seen in FIG. 1, the columns are labeled to define the time units involved along the back edge of the tray at 26. The rows of time intervals are labeled and identified along the left edge of the tray 10 as at 28. The labeling indicia includes both a written designation of the time interval involved and also indicia in the form of a colored field associated with each time interval. The color red is associated with morning, yellow with noon, blue with evening, and black with night. One of the pill holding compartments in each time unit or day is also identified by similar colored indicia. Thus each of the four rows of indicia has its own color identifying its own time interval.

Seven sliding panels 38 are slidably mounted with respect to the tray, one in position to close off all of the compartments 16 in each of the columns 31 through 37. Each sliding panel slides on a horizontal path partially defined by top edges 40 of row boundary walls 41 between the rows of compartments 16 below the panels, and protrusions 42 in the vertically extending column walls 44 between the columns of compartments 16 above the panels.

Figure 4:
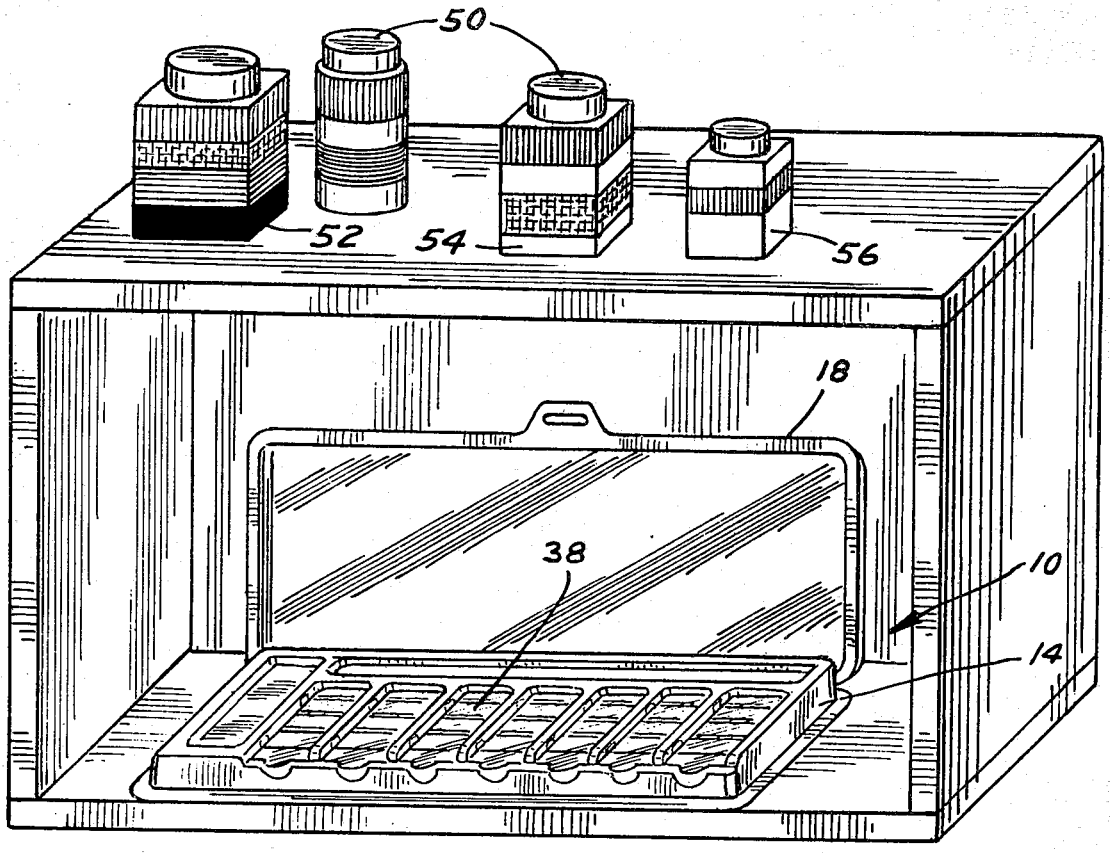
FIG. 4 is a perspective view of the pill tray of FIGS. 1 through 3 and of a plurality of color-coded pill containers for containing pills to be loaded into particular pill holding compartments of the pill tray of the invention.
Figure 3:
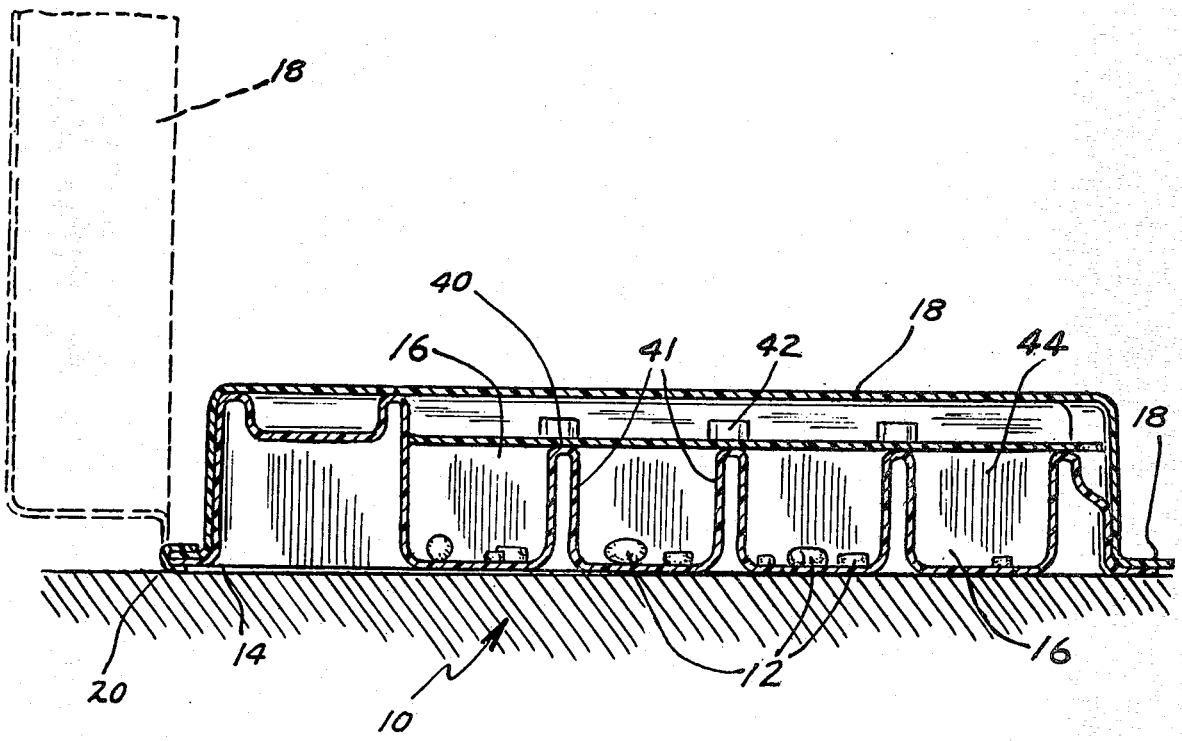

As seen in FIG. 4, pill bottles or pill containers 50 are provided for each unique variety of pill to be dispensed. Each pill container is then identified as to each of the time intervals for dispensing the pills it carries with indicia identical to the indicia representative of those same time intervals in the tray 10. Thus each variety of pill which is to be dispensed during the morning is put into a separate pill container identified with the red indicia of row 21 indicating that it contains pills to be dispensed in the morning. If the same variety of pill is also to be dispensed at noon, that container will also be identified with yellow indicia, etc. Thus pill container 52 contains pills to be stored in each compartment in rows 21, 22, 23 and 24. Pill container 53 contains pills to be stored in each compartment in rows 21 and 23. Pill container 54 contains pills to be stored in each compartment in rows 21 and 22; and pill container 56 contains pills to be stored in each compartment of row 21.

In order to reduce the possibility of medication errors in a geriatric population, for example, the medical facility providing the pill tray 10 will also provide a full set of pill containers 50 each marked with the proper indicia as set out above. The geriatric patient can then charge or load his tray 10 with the maximum possible assurance that it will be properly loaded. This is done by pivoting the tray cover 18 up and over into clearing relation to the base 14 to uncover the tray and each of the seven sliding panels 38. The panels 38 can be removed, and one or more pills (depending on the particular prescription) can be unloaded from each of the pill containers into each of the compartments 16 identified by the same color indicia as is that pill container. The sliding panels 38 can be replaced, and the cover brought down on top of the tray and on top of the sliding panels so that each dosage of pills for each time interval of each time unit is safely isolated against loss or mixing with other pills in other compartments.

In order to reduce or eliminate medication errors in the dispensing of the pills, the pills will be stored in the tray as explained; and, upon arrival of the first interval of the first time unit, for example, breakfast of Monday morning, the tray cover 18 will be pivoted back out of the way, and the sliding panel 38 covering the compartments of column 31 will be moved to position as seen in FIG. 1. In this position, every pill holding compartment 16 remains covered except the single compartment holding the pills which are to be dispensed on Monday morning. The patient withdraws the pills and ingests them as prescribed. Sliding panel 38 of column 31 is repositioned, the cover 18 is replaced to trap all of the sliding panels against accidental dislodgment, and the pill tray is set aside until Monday noon. At this point, the sliding panel covering column 31 is slid down to expose the now empty Monday morning compartment 16 and the still charged Monday noon compartment so that the pills can be removed from it. This process is continued throughout the week.

At some point later in the week, say Saturday afternoon, the tray can be opened and the compartments in columns 31 through 35 and the top half of column 36 can be recharged without any danger that the pills allocated for the remainder of Saturday and Sunday will be displaced.

Although the present invention has been described with reference to preferred embodiments, workers skilled in the art will recognize that changes may be made in form and detail without departing from the spirit and scope of the invention.

What is claimed is:

1. A method of accurately selecting, storing and dispensing multiple varieties of pills at a given number of preselected time intervals during each of a number of time units such as days over a set time period such as a week, including the steps of:

assembling each variety of pill to be dispensed in an individual pill container containing only that variety;

identifying each such pill container with color-coded indicia distinctive of each of the time intervals during which the pills contained in it are to be dispensed;

providing a pill tray having a plurality of pill storage compartments of sufficient number to provide a separate pill storage location for each interval of each time unit;

identifying each pill storage compartment with one of the same color-coded indicia as used on the pill containers to indentify one or more of the time intervals so that there will be the same number of pill storage compartments identified with each different time interval as there are time units in the time period;

charging each pill storage compartment with at least one pill from each pill container which is identified with the same color-coded indicia as that identifying the pill storage compartment; and serially dispensing all pills from each pill storage compartment as each time interval occurs in each time unit.

2. The method of claim 1 wherein the pill storage compartments are arranged with respect to the pill tray so that the compartments identified with each time interval are arranged in a series of rows, and the compartments identified with each time unit are arranged in columns.

3. The method of claim 1; and the steps of:

providing means for covering each of the pill storage compartments and for serially uncovering the compartments one after another in appropriate order as each time interval occurs in each time unit.

4. The method of claim 2; and the step of:

providing means for covering each of the pill storage compartments and for serially uncovering the compartments one after another in appropriate order as each time interval occurs in each time unit.

5. The method of claim 1 wherein:

the time period is one week, the time units are days, and the time intervals are identified with recognizable portions of a day.

6. The method of claim 2 wherein:

the time period is one week, the time units are days, and the time intervals are identified with recognizable portions of a day.

7. The method of claim 6 wherein:

the recognizable portions of the day are morning or breakfast time, noon or lunch time, evening or supper time and night or bedtime.

8. An apparatus for accurately selecting, storing and dispensing multiple varieties of pills at a given number of preselected time intervals during each of a number of time units such as days over a set time period such as a week, said apparatus including:

an individual pill container for each variety of pill to be dispensed during a particular time interval, each such pill container containing only its variety of pill;

each such pill container being identified with color-coded indicia distinctive of each of the time intervals during which the pills contained in it are to be dispensed;

a pill tray including:

a base, a plurality of pill holding compartments associated with the base, each compartment representative of one of the time intervals during which pills may be dispensed, each compartment being sized to hold a charge consisting of at least the maximum number of pills which are to be consigned to it, said pill compartment being arranged in columns each identified with one of the units of the time period and in rows each identified with one of the time intervals common to all of the time units, means to identify each compartment of each row with color-coded indicia clearly distinguishable from that identifying the compartments of each other row, such color-coded indicia corresponding to the color-coded indicia used to identify the pill containers associated with that time interval, and means to retain a charge of pills in each compartment and to selectively open each compartment during its represented time interval of its time unit for access to its charge of pills.

9. The apparatus of claim 8 wherein:

the time period is a week, the time units are days and the time intervals are identified with recognizable occurences during a day.

10. The apparatus of claim 9 wherein:

the means to retain the pills in their compartments and to selectively open each compartment includes a sliding panel aligned with each of the pill holding compartments of each of the columns and movable by compartment sized steps between a first position wherein it covers all of the compartments in its column and a second position wherein it covers none of such compartments.

11. The apparatus of claim 10 wherein:

said pill tray also includes a cover movable between an open position permitting access to all sliding panels and all pill holding compartments and a closed position wherein all covered panels are held in said panel first position covering all of the compartments of its column.

12. A tray for receiving, storing and dispensing multiple varieties of pills at predetermined frequencies at a given number of time intervals during a set time period made up of a plurality of time units, said tray including:

a base, a plurality of pill holding compartments associated with the base, each compartment representative of one of the time intervals during which pills are to be dispensed, each compartment being sized to hold a charge consisting of at least the maximum number of pills which are to be consigned to it;

said compartments being arranged in columns each representative of one of the units of the time period and in rows each representative of one of the time intervals of all of the time units;

means to identify each compartment of each row with color-coded indicia clearly distinguishable from that identifying the compartments of every other row; and means to retain a charge of pills in each compartment and to selectively open each charged compartment during its represented time interval for access to its charge of pills.

* * * * *

UNITED STATES PATENT AND TRADEMARK OFFICE

CERTIFICATE OF CORRECTION

PATENT NO. : 4,473,156

DATED : September 25, 1984

INVENTOR(S) : David C. Martin

It is certified that error appears in the above-identified patent and that said Letters Patent are hereby corrected as shown below:

Assignee: "St. Paul-Ramsey Hospital Medical" should read --St. Paul-Ramsey Hospital Medical Education and Research Foundation--.

Signed and Sealed this

*Twenty-sixth* Day of *February 1985*

[SEAL]

*Attest:*

DONALD J. QUIGG

*Attesting Officer*

*Acting Commissioner of Patents and Trademarks*